US005809761A

United States Patent [19]

Waters

[11] Patent Number: 5,809,761

[45] Date of Patent: Sep. 22, 1998

[54] PNEUMATIC YARN SPLICER

[75] Inventor: Graham T. Waters, Abergavenny, United Kingdom

[73] Assignee: Pentwyn Splicers Limited, Ponty pool, United Kingdom

[21] Appl. No.: 765,272

[22] PCT Filed: Jun. 22, 1995

[86] PCT No.: PCT/GB95/01481

§ 371 Date: Jun. 17, 1997

§ 102(e) Date: Jun. 17, 1997

[87] PCT Pub. No.: WO96/00182

PCT Pub. Date: Jan. 4, 1996

[30] Foreign Application Priority Data

Jun. 23, 1994 [GB] United Kingdom ..... 9412679

[51] Int. Cl.[6] ..... D01H 17/00

[52] U.S. Cl. ..... 57/22; 57/23

[58] Field of Search ..... 57/22, 23

[56] References Cited

U.S. PATENT DOCUMENTS

| | | | |
|---|---|---|---|
| 3,379,002 | 4/1968 | Rosenstein | 57/22 |
| 4,419,858 | 12/1983 | Rohner et al. | 57/22 |
| 4,424,663 | 1/1984 | Rohner et al. | 57/22 |
| 4,452,035 | 6/1984 | Rohner et al. | 57/22 |
| 5,152,131 | 10/1992 | Locatelli | 57/22 |

FOREIGN PATENT DOCUMENTS

| | | |
|---|---|---|
| 41818 | 12/1981 | European Pat. Off. . |
| 3924827 | 1/1991 | Germany . |
| 2068003 | 8/1981 | United Kingdom . |

*Primary Examiner*—William Stryjewski

*Attorney, Agent, or Firm*—McAndrews, Held & Malloy

[57] ABSTRACT

A pneumatic yarn splicer comprises a splicer body which defines a splicing chamber in which yarns to be spliced are disposed. The chamber has an open side and open ends, with an enlarged section therebetween. A pad is provided for closing the open side of the chamber, and a port in the chamber wall normally substantially opposite the open side, provides for delivery of an air blast to splice yarns in the chamber. A restrictor plate is fitted at one end of the body to partially close an open end of the chamber.

14 Claims, 2 Drawing Sheets

PNEUMATIC YARN SPLICER

BACKGROUND AND SUMMARY OF THE INVENTION

This invention relates to pneumatic yarn splicing. This process has numerous advantages over traditional methods of joining textile yarns such as knotting, principally because spliced yarns offer improved appearance and processing efficiency. Splicing is firmly established in the textile industry, and in many applications its use is mandatory in order to achieve acceptable standards of yarn quality.

In one form of splice, the yarns to be joined are introduced from opposite ends of the splicer. They are laid in a splicing chamber, and the chamber is sealed by a moveable component known as a chamber pad. The waste ends of the two yarns are cut by knives at either end of the chamber. Air is introduced into the chamber as a high pressure blast, which intermingles the fibres of the yarns. When the blast is turned off, the pad is opened to allow the spliced yarn to be removed. The splice is symmetrical in form, and usually has a neat appearance. This form of splice is described as "ends-opposed". In an alternative form of splice, both yarns are introduced from the same end of the splicer. The waste ends of the two yarns are cut at the other end of the chamber. The splice is asymmetrical in form, and usually has a "tail" several millimetres long projecting to one side. This form of splice is described as "ends-together".

The ends-together splice has a relatively poor appearance, but it is popular because it is quick to make, and in many situations its inferior appearance is unimportant. Further, some yarns pose technical problems which render ends-together splices the only joints that can be made.

When the blast enters the chamber in a splicing process, the yarn components are subjected to a turbulent air-stream, moving at high velocity; the dynamics of the system are very complex. If splicing is to be successfully accomplished, the system must remain relatively stable while certain processes take place.

With both ends-opposed and ends-together splices, two separate physical processes must occur in quick succession:

a) mixing of the fibres of the yarn components b) intermingling of the fibres of the mixed bundle If either process is deficient, the splice will fail.

If the mixing process is unsuccessful, then the intermingling stage is irrelevant; it succeeds only in consolidating each component, but does not join them together. In practice, the two yarn components are quickly blown out of the splicing chamber without a splice being formed. If the mixing process is successful, but the intermingling is poor, then the splice is unsatisfactory. When the splice is withdrawn from the chamber, it may appear acceptable, but it will have little or no strength.

Splicing chambers are designed to maximise the efficiency of the two processes of mixing and intermingling. In some respects, however, the performance of splicers is unsatisfactory. In some circumstances, the dynamics of the system within the splicing chamber can become unstable, with the result than the yarns are quickly ejected without a splice being formed.

This invention is concerned only with ends-together splicing. In the formation of an ends-together splice the two yarns are introduced to the splicing chamber together, from one side and are secured, usually by yarn clamps. The air blast normally enters the splicing chamber before the yarn bundle is cut, and exhausts roughly equally to left and right of the chamber. With the yarn bundle secured by yarn clamps, the system is in dynamic equilibrium.

Once the yarn bundle is cut, the system becomes inherently unstable. The yarn bundle remains secured by a clamp on the entry side of the chamber, but is no longer restrained at the cutting side. If any asymmetries are introduced into the system, the yarn bundle will usually move away from the side which is unrestrained. It will therefore have a tendency to blow out of the chamber on the entry side. If the fibres of the yarns mix and intermingle quickly, then a splice will form by the time the bundle is ejected. If little or no mixing and intermingling takes place, then the two yarns will be ejected as separate entities, without a splice being formed. In general, a satisfactory ends-together splice can be made only if the yarn bundle remains in the chamber for a critical period.

To combat the inherent instability, some means of controlling the residence time within the chamber is needed, to inhibit the ejection of the bundle until the fibres have had an opportunity to intermingle. The yarn bundle needs to be restrained. Poor restraint will result in a wide variation of residence time, and splices of variable quality; positive restraint will result in tight control of residence time, and consistent splices. Additionally, the splicing chamber should be configured to encourage the efficient mixing and intermingling of the films.

Splicers can be fitted with timers, which control the duration of the blast. With ends-together splices, however, a timer will not control residence time; the yarn will blow out of the chamber if the bundle becomes unstable, no matter what the duration of the blast.

The residence time of the ends-together splice can be controlled to some degree by careful choice of the geometry of the splicing chamber, the size of the chamber being chosen to match the yarn very precisely. Friction between the yarn and the chamber wall then inhibits the movement of the yarn bundle. This means of conferring stability is fairly effective, but it demands the use of a large number of chambers if a wide range of yarns is to be spliced.

The present invention addresses both the above issues and is directed at a splicer which in given arrangement, can be used for a wide range of yarn types and sizes, and in which residence time is controlled more precisely by the use of a positive system of restraint. According to the present invention, this is accomplished by the provision of an enlarged section in the splicing chamber, and by controlling the geometry of the splicing chamber on the yarn-entry side. These features obviate the need to select different splicing chambers to suit the characteristics of the yarns used. Such a system is essential passive, requiring no moving components. It allows the yarns to enter the chamber unhindered, and the completed splice to leave the chamber easily, without undue intervention by the operator. Further, by encouraging the efficient mixing and intermingling of yarns in the enlarged section, and controlling the geometry of the splicing chamber end, the system can substantially ensure retention of the yarns within the chamber for a time which permits the formation of an acceptable splice.

A pneumatic splicer according to the invention comprises a splicer body defining a splicing chamber for receiving yarns to be spliced, the chamber having an open side and open ends with an enlarged section between the ends; a pad for closing the open side; a port in the chamber wall at the enlarged section for delivery of an air blast to splice yarns in the chamber; and a restrictor plate partially closing an open end of the chamber. Normally, the chamber cross-section on either side of the enlarged section is substantially uniform.

The enlarged section of the splicing chamber may take a variety of shapes, but typically, it is symmetrical about an axis and has a circular cross-section transverse thereto. The air port is normally aligned with the axis which itself will usually be oriented perpendicular to the axis of the chamber. In preferred embodiments, the enlarged section is substantially hemispherical adjacent the air port.

In preferred embodiments of the invention, the cross-section of the splicing chamber is a trapezium, usually isosceles, with the larger of the parallel sides being at the open side of the chamber. Many different shapes of restrictor plates can be used in splicers of the invention. Preferred shapes are those which complement the respective chamber end to define readily accessible entry openings for the yarn or yarns. For example, an entry opening with parallel or converging sides is particularly preferred.

The restrictor plate will normally close the respective end of the splicing chamber by an amount not exceeding 50%, the amount preferably not exceeding 30%. In a typical arrangement, the restrictor plate has a triangular cut away section extending from the open side of the splicing chamber. Generally the partial closure of the respective open end of the splicing chamber by the restrictor plate is opposite the open side of the chamber and substantially symmetric relative to a normal therefrom through a central axis of the chamber. Alternatively though, the partial closure of the chamber by the restrictor plate can be made deliberately asymmetric relative to the chamber axis.

BRIEF DESCRIPTION OF THE DRAWINGS

The invention will now be described by way of example and with reference to the accompanying schematic drawings wherein.

DESCRIPTION OF THE PREFERRED EMBODIMENTS

Figure 1:
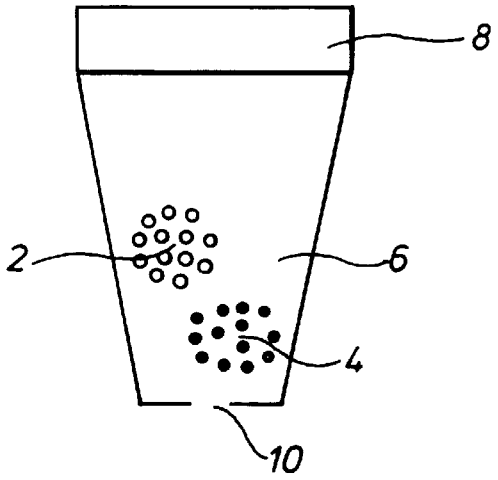
FIGS. 1, 2 and 3 show a transverse cross-sectional view of a splicing chamber in which an "ends-together" splicer is being formed.
Figure 2:
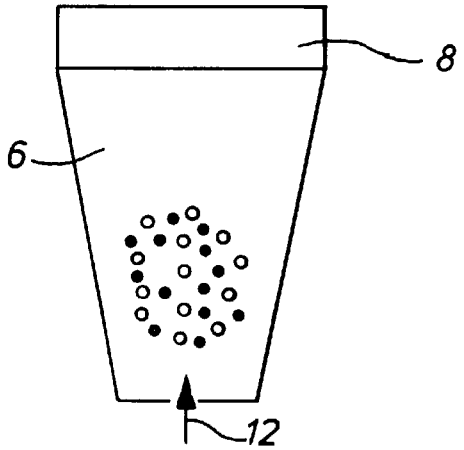
Figure 3:
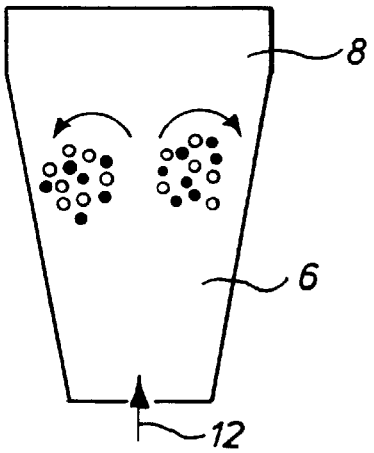

In FIGS. 1 to 3 the individual fibres of the two yarns to be spliced are shown in different shades. Initially, the yarns 2 and 4 are laid in the splicing chamber 6 and the open side of the chamber then closed by a chamber pad 8, as shown in FIG. 1. The air blast port 10 is shown at the base of the chamber, opposite the open side.

When the air blast 12 enters the chamber 6 as shown in FIG. 2, the coherence of each yarn is disturbed; the fibres are separated, and move so that the fibres of one yarn become intimately mixed with those of the other. This process continues until the mixed fibres align themselves in the respective yarns, and intermingle as shown in FIG. 3. The completed splice can then be withdrawn from the chamber 6, either through the open side after removal of the pad 8, or through the open end from which the spliced yarns enter. Without a restraint system, there is a risk that the yarns will be ejected from the chamber through the respective open end without or prior to the splice being formed.

Figure 4:
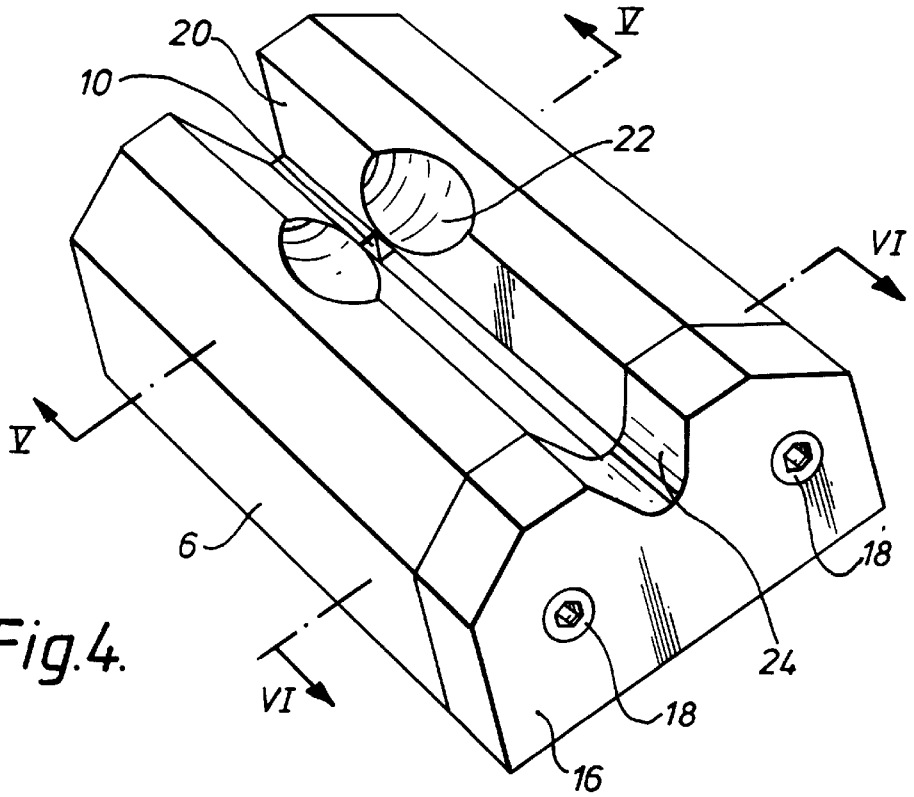
FIG. 4 shows a perspective view of a splicer body in an embodiment of the invention, with a restrictor plate attached thereto.
Figure 5:
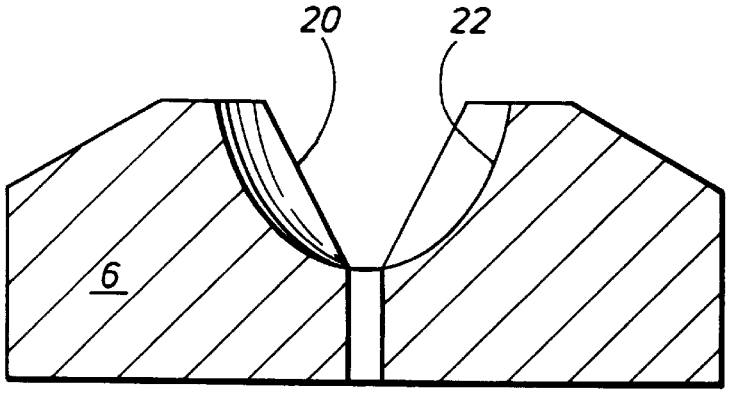
FIGS. 5 and 6 are sectional views taken on lines V—V and VI—VI respectively in FIG. 4.

As shown in FIG. 4, a restrictor plate 16 is attached to the splicer body 6 by bolts or screws 18. The splicer body is formed with an elongate groove which defines the splicing chamber 20 which has two sections with the cross-section of an isosceles trapezium, one on either side of an enlarged section 22. The included angle of the sides of the trapezium is normally no more than 60°, typically around 30°. In the embodiment shown in the drawings, the enlarged section 22 is substantially in the shape of a hemisphere, and can be readily formed by a "bull-nose" bit of a conventional drill. The diameter of the hemisphere is typically 8 to 10 mm. The axis of the hemisphere is normal to the base of the splicing chamber 20, but this is not essential. Other shapes may be used for the enlarged section, as may other inclinations of its axis, and each will achieve slightly different effects. However, we have found that consistent results over a wide range of yarn types can be achieved using a hemispherical section of the kind shown.

The enlarged section 22 is not disposed centrally with respect to the splicing chamber 20. Rather, it is disposed towards the end thereof remote from the restrictor plate 16. As will be explained in more detail, this allows the splice to be formed a little further from the point at which the yarns are held, and reduces the length of the tails.

Figure 6:
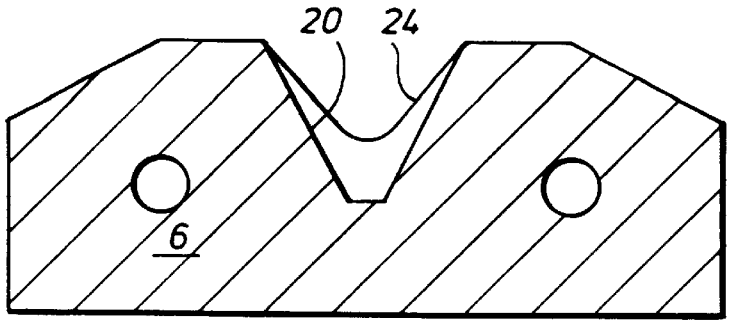

As will be apparent from FIGS. 4 and 6, the cross-sectional shape of the restrictor plate 16 is very similar to that of the body 6. Indeed, the only essential difference is the shape of the cutaway section 24 which is aligned with the splicing chamber 20. The cutaway section 24 extends away from the open side of the splicing chamber and is substantially triangular. In the embodiment shown, the area of the triangular cutaway section is around 75% of the cross-sectional area of the splicing chamber. While the reduction in cross-section is relatively small, it does have a very significant effect. Particularly, it reduces the area through which the blast air can escape on the yarn entry side, and thus inhibits and effectively prevents premature ejection of the yarns.

The restrictor plate 16 is illustrated by way of example only. The essential feature is that it partially closes the end of the splicing chamber 20. Its shape, and the presence or shape of a cutaway section is not critical. Thus, a rectangular plate blocking a lower section of the splicing chamber cross-section can be quite satisfactory.

When the blast enters the chamber 20, the presence of the plate 18 restricts the exhaust air flow on the end through which the yarns have entered. Most of the air exhausts from the opposite end of the chamber 20, generating a biasing force towards that end. This force retains the yarn bundle in the chamber. The biasing force may be altered by the shape and orientation of the enlarged section 22. Since the yarn bundle cannot easily blow out of the chamber, the fibres are given time to mix and intermingle.

With continuous filament yarns, as mixing and intermingling proceeds, the bundle begins to twist up and, as it contracts, is drawn back across the blast hole. With staple yarns loose fibres are blown away during this phase. The length of the yarn bundle on the knife or cutting side reduces, and the biasing force reduces correspondingly. Finally, the force is exceeded by that acting back toward the entry side. The yarns are pushed back towards the entry side, and expelled.

FIG. 4 shows the attachment of the restrictor plate 16 to the splicer body 6 by simple screws or bolts which enable it to be readily removed. Its removal, and replacement by a restrictor plate with a cutaway section of different size or cross-section, enables the plate to be selected for particular yarn sizes, materials, number, and twist etc. However, we have found that whereas previously care had to be taken to match a splicing chamber with these yarn criteria, adopting the present invention enables a single assembly, of splicer body and restrictor plate, to be used on a much wider range of yarn than was previously possible for a single splicer. Further, we have found that splicers embodying the invention can be used to create reliable splices between yarn comprising different types of fibres, and with different twists.

I claim:

1. A pneumatic yarn splicer comprising a splicer body formed with a chamber wall defining an elongate splicing chamber for receiving yarns to be spliced, the chamber wall being on opposite sides of an axis extending the length of the splicing chamber, and the chamber having an open side and open ends and being formed with a first end portion extending from one end to an intermediate portion, and a second end portion extending from the intermediate portion to the other end, the intermediate portion having an enlarged cross-section relative to the cross-section of the first end portion or the second end portion, said enlarged cross-section being enlarged on both said opposite sides of the splicing chamber axis; a pad for closing the open side; a port in the chamber wall at the intermediate chamber portion for delivery of an air blast to splice yarns in the chamber; and a restrictor plate partially closing an open end of the splicing chamber.

2. A yarn splicer according to claim 1 wherein the cross-section of each of the first and second chamber end portions is substantially uniform.

3. A yarn splicer according to claim 1 wherein the intermediate portion of the splicing chamber is symmetrical about a port axis perpendicular to the splicing chamber axis and has a circular cross-section transverse thereto, the air port being aligned with the port axis.

4. A yarn splicer according to claim 3 wherein the axis of symmetry of the enlarged section is substantially perpendicular to the axis of the chamber.

5. A yarn splicer according to claim 1 wherein the cross-section of the splicing chamber of each of the first and second chamber end portions is a trapezium.

6. A yarn splicer according to claim 5 wherein said cross-section is an isosceles trapezium.

7. A yarn splicer according to claim 1 wherein the restrictor plate closes the respective end of the splicing chamber by an amount not exceeding 50%.

8. A yarn splicer according to claim 7 wherein the degree of closure does not exceed 30%.

9. A yarn splicer according to claim 1 wherein the restrictor plate has a triangular cut away section extending from the open side of the splicing chamber.

10. A yarn splicer according to claim 1 wherein the partial closure of the respective open end of the splicing chamber by the restrictor plate is opposite the open side of the chamber and substantially symmetric relative to a normal therefrom through a central axis of the chamber.

11. A yarn splicer according to claim 1 wherein the partial closure of the respective open end of the splicing chamber by the restrictor plate is opposite the open side of the chamber and asymmetric relative to a normal therefrom through a central axis of the chamber.

12. A yarn splicer according to claim 1 wherein the restrictor plate is mounted on the splicer body for lateral adjustment relative to the splicing chamber.

13. A yarn splicer according to claim 1 wherein the restrictor plate is mounted on the splicer body for axial adjustment relative to the splicing chamber.

14. A pneumatic yarn splicer comprising a splicer body formed with a chamber wall defining an elongate splicing chamber for receiving yarns to be spliced, the chamber wall being on opposite sides of an axis extending the length of the splicing chamber, and the chamber having an open side and open ends and being formed with a first end portion extending from one end to an intermediate portion, and a second end portion extending from the intermediate portion to the other end, each of the first and second end portions having a substantially uniform cross-section, the intermediate portion having an enlarged cross-section relative to the cross-section of the first end portion or the second end portion, said enlarged cross-section being enlarged on both said opposite sides of the splicing chamber axis, a pad for closing the open side; a port in the chamber wall at the intermediate chamber portion for delivery of an air blast to splice yarns in the chamber, and a restrictor plate partially closing an open end of the splicing chamber wherein the intermediate portion of the splicing chamber is symmetrical about a port axis perpendicular to the splicing chamber axis and has a circular cross-section transverse thereto, the air port being aligned with the port axis and wherein the intermediate portion is substantially hemispherical adjacent the air port.

* * * * *